US008833674B2

(12) United States Patent
Lo

(10) Patent No.: US 8,833,674 B2
(45) Date of Patent: Sep. 16, 2014

(54) ADJUSTABLE SPRINKLER

(76) Inventor: Shun-Nan Lo, Taichung (TW)

( * ) Notice: Subject to any disclaimer, the term of this patent is extended or adjusted under 35 U.S.C. 154(b) by 642 days.

(21) Appl. No.: 12/662,420

(22) Filed: Apr. 16, 2010

(65) Prior Publication Data

US 2011/0253813 A1 Oct. 20, 2011

(51) Int. Cl.
*B05B 3/00* (2006.01)
*B05B 15/06* (2006.01)
*B05B 3/04* (2006.01)

(52) U.S. Cl.
CPC ..... *B05B 15/066* (2013.01); *B05B 15/069* (2013.01); *B05B 3/04* (2013.01); *B05B 15/063* (2013.01)
USPC ..... 239/227; 239/225.1

(58) Field of Classification Search
USPC ..... 239/214, 219, 220, 237, 238, 239, 242, 239/236, 263, 380, 227, DIG. 15
See application file for complete search history.

(56) References Cited

U.S. PATENT DOCUMENTS 3,878,990 A * 4/1975 Geraudie ..... 239/236
4,198,001 A * 4/1980 Rodriguez ..... 239/227
7,566,012 B2 * 7/2009 Wang et al. ..... 239/237

* cited by examiner

*Primary Examiner* — Len Tran
*Assistant Examiner* — Viet Le
(74) *Attorney, Agent, or Firm* — Raymond Y. Chan; David and Raymond Patent Firm

(57) ABSTRACT

An adjustable sprinkler includes a base and a mobile tube. The base has a vertical water way and a transverse axle tube linked to an upper end of the vertical water way. The transverse axle tube has at least one water outlet. An axial water way and a water outlet are formed to an end of the mobile tube, a transverse axle hole connected the water way is formed to the end also. The transverse axle tube can be received by the transverse axle hole. An inner wall of the transverse axle hole has the same quantity of protrusion with the water outlets of the transverse axle tube. The protrusions will be rotated to cover the water outlets. Another end of the mobile tube has an extension portion bent downwards.

7 Claims, 8 Drawing Sheets

ADJUSTABLE SPRINKLER

FIELD OF THE INVENTION

The present invention relates to nozzle, and particular to a nozzle with adjustable spout range.

DESCRIPTION OF THE PRIOR ART

In accordance of a U.S. Pat. No. 5,769,322, a rotary sprinkler and a base are disclosed. A lateral side of a base has a water inlet, and a water outlet formed to an upper end thereof. A round disk is arranged around the water outlet. A plurality of spacing hole is formed to the round disk with predetermined gap between. A plurality of adjusting foot is formed below an elastic round track formed around the water outlet. The plurality of the adjusting foot can be inserted into the plurality of spacing hole for specific height adjustment. An automatical spinning sprinkler driven by water is connected upon the water outlet. A plurality of nozzle arranged vertically is formed to a later side of the sprinkler with a predetermined angle of elevation. A diversion plate arranged to the sprinkler has extending diversion sheet formed above the nozzle. A bent down linking rod is arranged to an opposite side of the diversion plate to the diversion sheet. A spring is arranged between the linking rod and the diversion plate so that a bottom of the linking rod is attached to the round track and being up and down on the track.

Therefore, while water coming into the sprinkler, the sprinkler is spinning with spout coming out from the nozzles. The diversion plate and the diversion sheet spinning with the sprinkler will be swung up and down by levering of the linking rod. The spout of the nozzle will not be blocked by a up-raised diversion sheet so as to reach a far range. In the contrary, the spout of the nozzle will have a short range while the spout is blocked by a lowered diversion sheet.

The above assembly can achieve a ranged control by the diversion sheet as another U.S. Pat. No. D297255 "Sprinkler head" by the same inventor which only has a different outer appearance. However, the two inventions still have disadvantages needed to be corrected as the following.

1. The water flowing through the nozzle cannot be adjusted so that the spout blocked by a lowered diversion sheet will cause strong splash of water which might damage flowers and plants.

2. While the spring linking the diversion plate and the linking rod is inactive, the diversion sheet will no longer change a position to adjust the range of spout.

SUMMARY OF THE PRESENT INVENTION

Accordingly, a primary object of the present invention is to provide a sprinkler with automatic water flow control depending on a range of a spout.

Normally, protrusions of a transverse axle hole are away from water outlets of the transverse axle tube so that the water outlets are not blocked by the protrusions. A water way of a mobile tube has the largest angle of elevation. Water coming from a vertical water way of the base will flow into a transverse water way of the transverse axle tube. Through the water outlets of the transverse water way, water will flow into a transverse axle hole and the mobile tube so as to be sprinkled out of a nozzle through the water way of the mobile tube. Water will be sprinkled to the farthest range because there is no obstacle against the water flow in such circumstance.

While the mobile tube is pivoted on the transverse axle tube, the angle of elevation of the mobile tube is changed and the protrusions will be moved to cover the water outlets or entirely block the water outlets. Therefore, while the angle of elevation of the mobile tube is lowered, water flow will be decreased so that the range of the spout out of the nozzle will be shortened.

Besides, two water seals are arranged between the transverse axle tube and the transverse axle hole. The two water seals are arranged to two relative outer side of the water outlets of the transverse axle tube. In the embodiment, the water seal is located between an inner ring and an outer ring, and the assembly is arranged to the transverse axle hole of the mobile tube.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1, 2, and 4 to 7, a preferred embodiment of a adjustable sprinkler according to the present invention includes a base 10, a transverse axle tube 20, and a mobile tube 30.

The base 10 has a vertical water way 11. A transverse through hole 12 is formed near an upper end of the vertical water way 11. A link tube 13 is arranged at a bottom of the vertical water way 11. The link tube 13 can be connected to a water outlet 102 of a sprinkler seat 100 as shown in FIGS. 8 and 9.

The transverse axle tube 20 has an axial transverse water way 21 formed inside the transverse axle tube 20. An open end 211 is formed to an end of the transverse water way 21, the open end 211 is connected to the transverse through hole 12. Another end of the transverse water way 21 has a close end 212. At least one water outlet 22 is formed to a peripheral of the transverse axle tube 20, the plurality of the water outlet 22 communicates the transverse water way 21.

The mobile tube 30 has an axial water way 31 formed inside the mobile tube 30. A water outlet 311 is formed to an end of the water way 31. An nozzle 32 capable of extending a range of the spout can be arranged to the water outlet 311. Another end of the water way 31 is connected to a transverse axle hole 33. The transverse axle hole 33 is formed to the mobile tube 30 near the water outlet 311, and the transverse axle hole 33 is perpendicular to the water way 31. The transverse axle tube 33 can receive the transverse axle tube 20. The transverse axle hole 3 has a plurality of protrusions 331 formed on an inner wall thereof. The plurality of the protrusion 331 matches to the plurality of the water outlet 22 of the transverse axle tube 20, the plurality of protrusion 331 can block the plurality of water outlet 22. Another end of the mobile tube 30 opposite to the water way 31 has an extension portion 34 bent downward so that a center of gravity of the mobile tube 30 is close to the extension portion 34 while the transverse axle hole 33 is regarded as a pivot.

Referring to FIG. 6, the protrusions 331 of the transverse axle hole 33 are away from the water outlets 22 of the transverse axle tube 20 in a normal status so that the water outlets 22 are not blocked by the protrusions 331. The water way 31 of the mobile tube 30 has the largest angle of elevation. Water coming from the vertical water way 11 of the base 10 will flow into the transverse water way 21 of the transverse axle tube 20. Through the water outlets 22 of the transverse water way 21, water will flow into the transverse axle hole 33 and the mobile tube 30 so as to be sprinkled out of the water outlet 311 through the water way 31 of the mobile tube 30. Water will be sprinkled to the farthest range because there is no obstacle against the water flow in such circumstance.

Referring to FIG. 7, while the mobile tube 30 is pivoted on the transverse axle tube 20, the angle of elevation of the mobile tube 30 is changed and the protrusions 331 will be moved to cover the water outlets 22 or entirely block the water outlets 22. Therefore, while the angle of elevation of the mobile tube 30 is lowered, water flow will be decreased so that the ranged of the spout out of the water outlet 311 will be shortened. Through the assembly, the mobile tube 30 will adjust water flow automatically depending on the range of the spout.

Besides, two water seals 40 are arranged between the transverse axle tube 20 and the transverse axle hole 33 as shown in FIGS. 5 and 7. The two water seals 40 are arranged to two relative outer sides of the water outlets 22 of the transverse axle tube 20. In the embodiment, the water seal 40 is located between an inner ring 41 and an outer ring 42, and the assembly is arranged to the transverse axle hole 33 of the mobile tube 30.

Moreover, the close end 212 of the transverse axle tube 20 is inserted into a support frame 50 for better positioning as shown in FIGS. 1, 3, and 5. A pivoting hole 51 for receiving the close end 212 is formed near an upper end of the support frame 50. A bottom of the support frame 50 is attached to a surface of the base 10. The support frame 50 has a rim 52 for being buckled by a retaining slot 14 formed to the base 10.

Referring to FIG. 1, a cover 60 capable of covering the mobile tube 30 and the extension portion 34 of the mobile tube 30 is arranged at the base 10. Only the nozzle 311 of the mobile tube 30 reveal outside the cover 60. The cover 60 is approximately a quarter of a circle. Two symmetric front tenons 61 and two symmetric rear tenons 62 are formed to two bottom lateral edges of the cover 60. Two symmetric front retaining recesses 15 and two symmetric rear retaining recesses 16 are formed to the base 10 for retaining the front and the rear tenons 61 and 62 respectively.

Referring to FIGS. 8 and 9, the adjustable sprinkler of the present invention is connected to a sprinkler seat 100 for lawn. The sprinkler seat 100 has a water inlet 101 on a lateral side. The water outlet 102 is arranged to a top of the sprinkler seat 100. An automatically spinning gear device driven by water flow is arranged below the water outlet 102 (not shown). A round disk 103 is arranged around the water outlet 102. A plurality of spacing hole (not shown) is formed to the round disk 103 with predetermined gap between. A plurality of adjusting foot 105 is formed below an elastic round track 104 formed around the water outlet 102. The plurality of the adjusting foot 105 can be inserted into the plurality of spacing hole for specific height adjustment.

Therefore, while the link tube 13 of the vertical water way 11 is connected to the water outlet 102 of the sprinkler base 100, the nozzle will be swung and rotated by the driving of water flow. The extension portion 34 of the mobile tube 30 will touch the round track 104 and swung up and down for adjust water flow and spout range as needed.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

Figure 1:
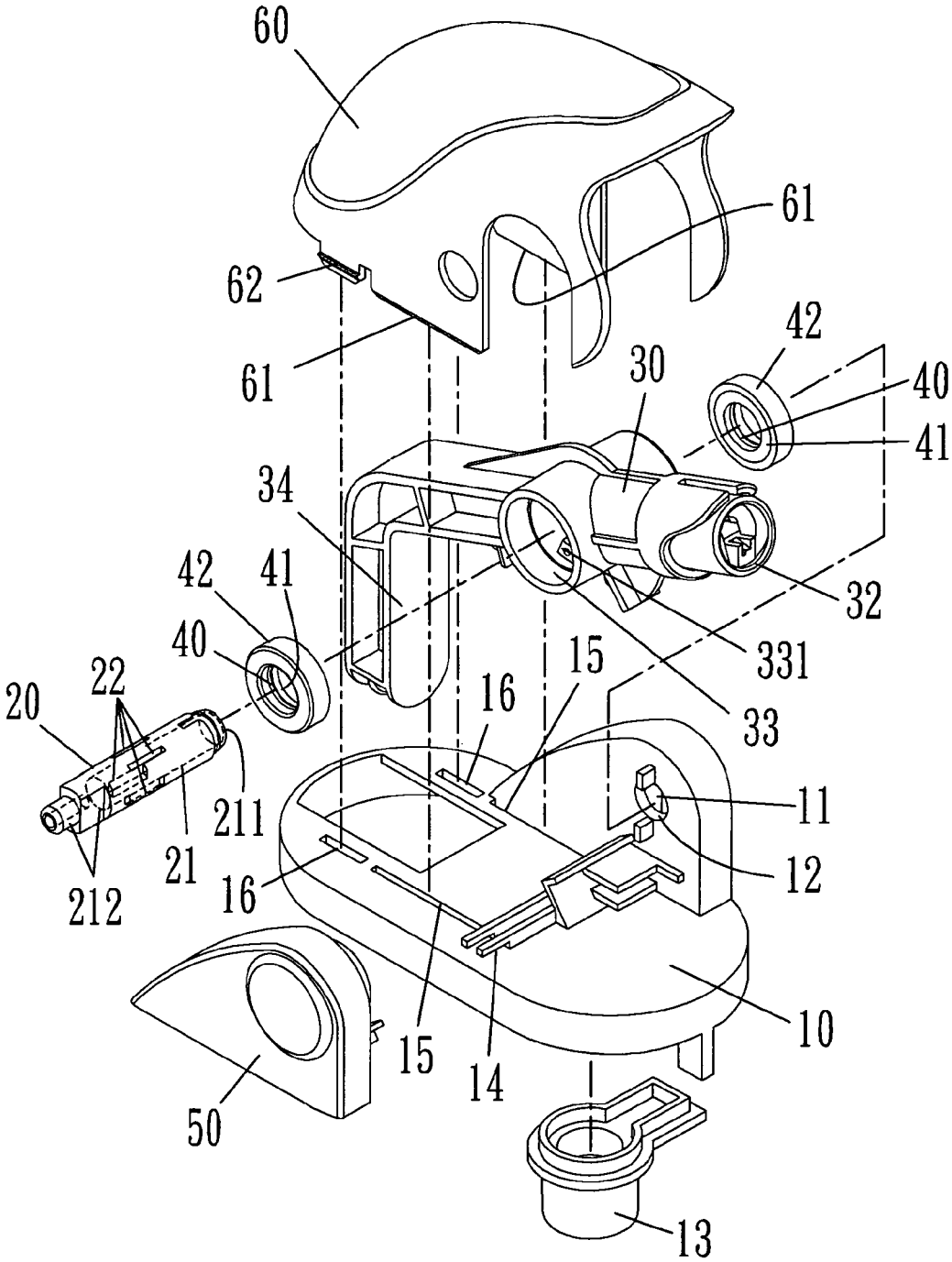
FIG. 1 is an exploded view of a preferable embodiment of the present invention.
Figure 2:
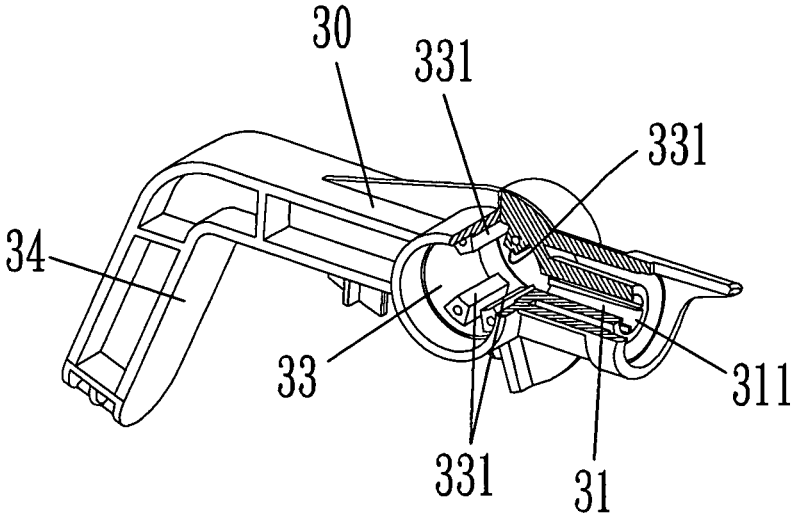
FIG. 2 is a cross-section view showing a mobile tube of the present invention.
Figure 3:
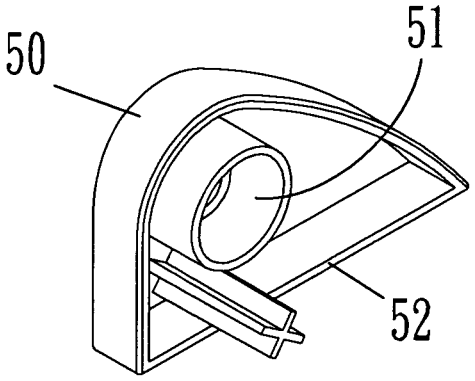
FIG. 3 is a schematic view showing a support frame of the present invention.
Figure 4:
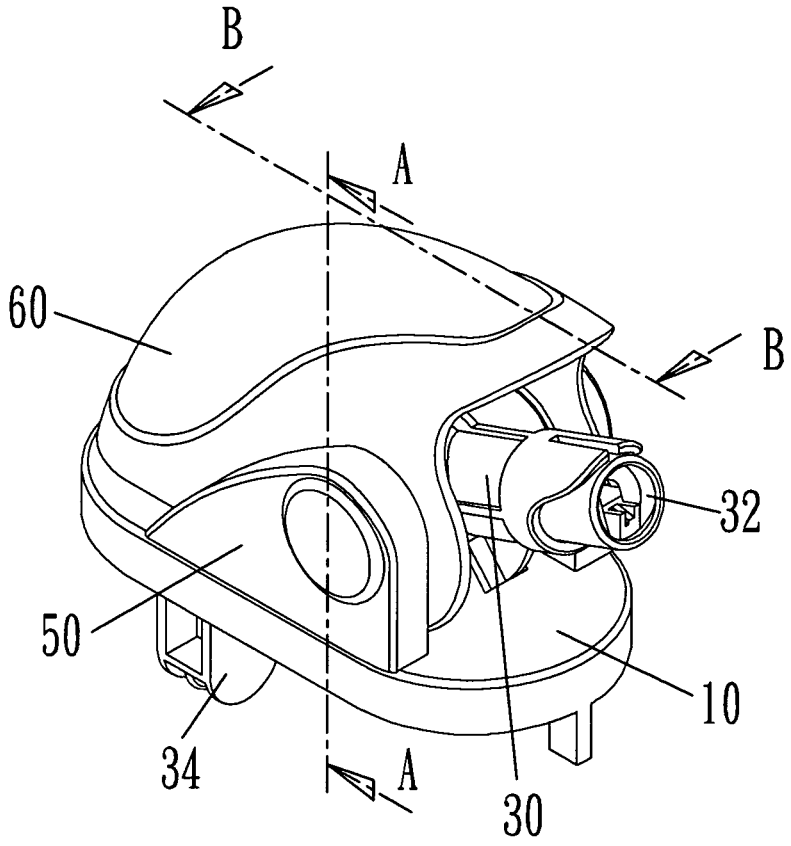
FIG. 4 is an assembly view of FIG. 1.
Figure 5:
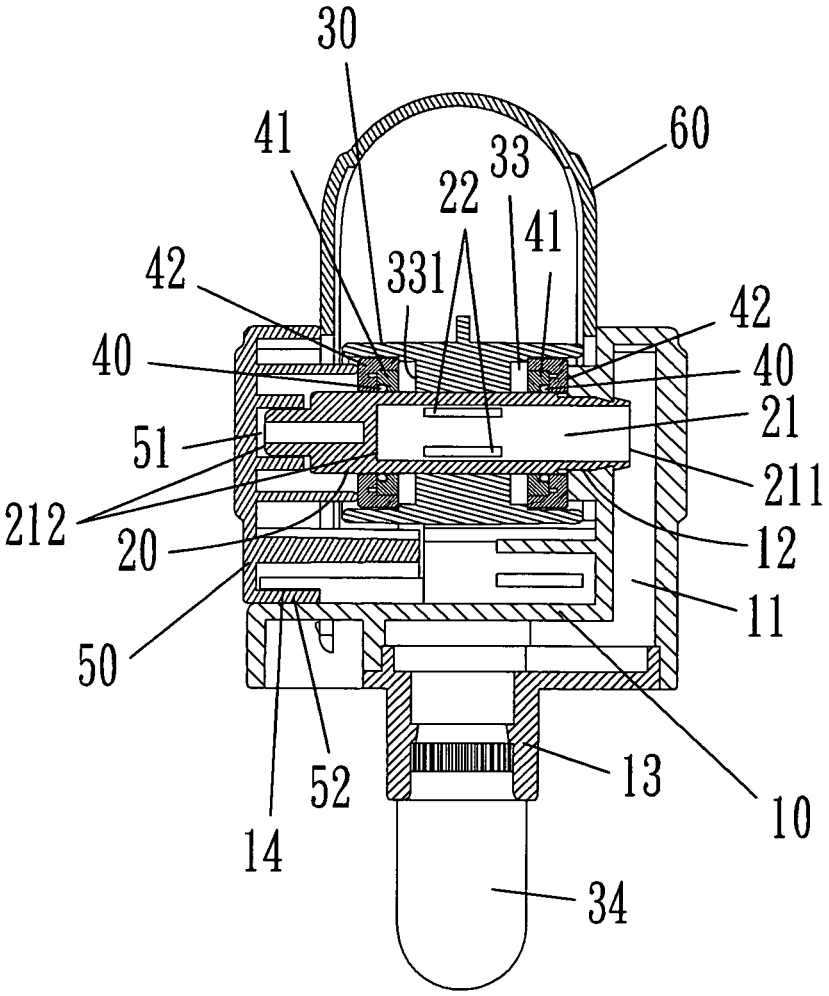
FIG. 5 is a cross-section view from an A-A line in FIG. 4.
Figure 6:
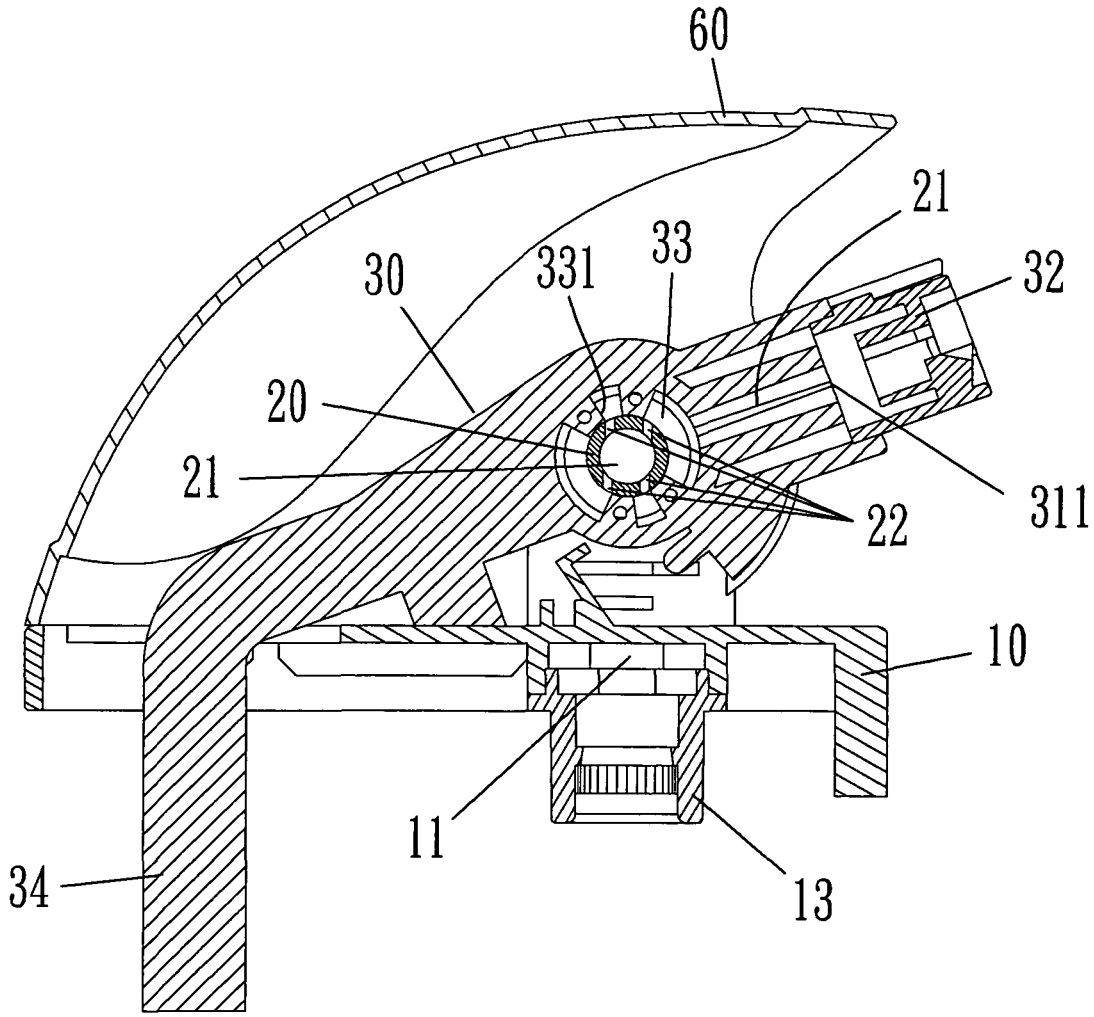
FIG. 6 is a cross-section view from a B-B line in FIG. 4.
Figure 7:
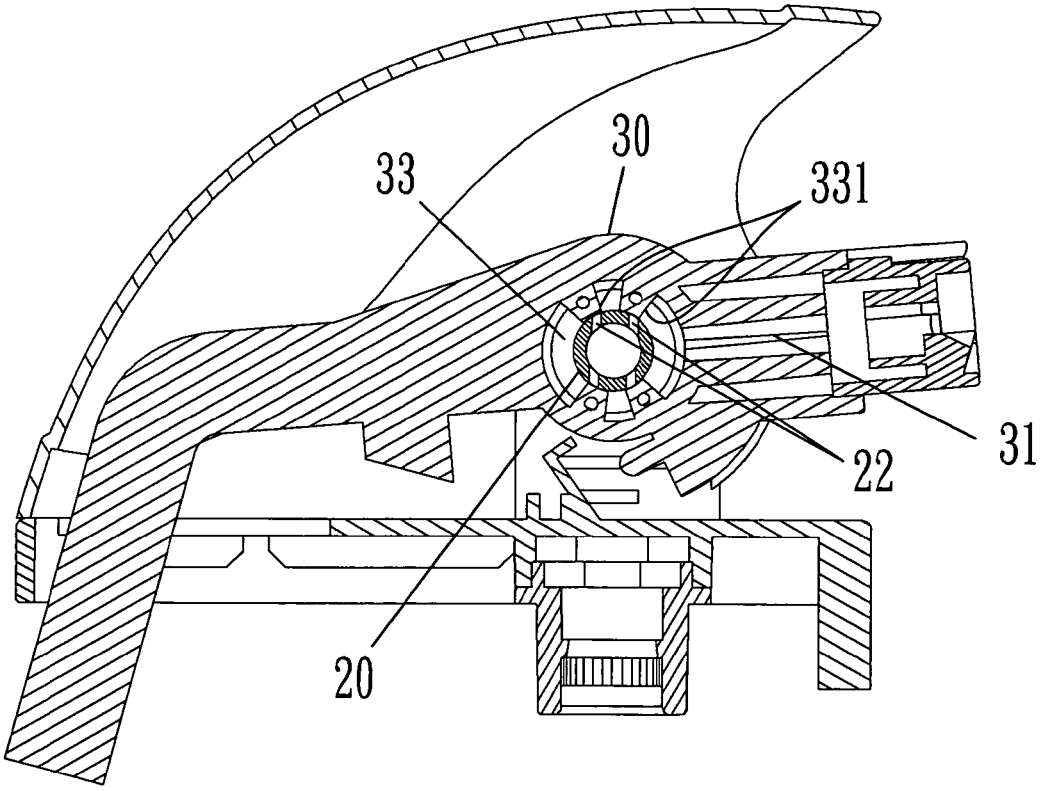
FIG. 7 is a schematic view showing an operation of FIG. 6.
Figure 8:
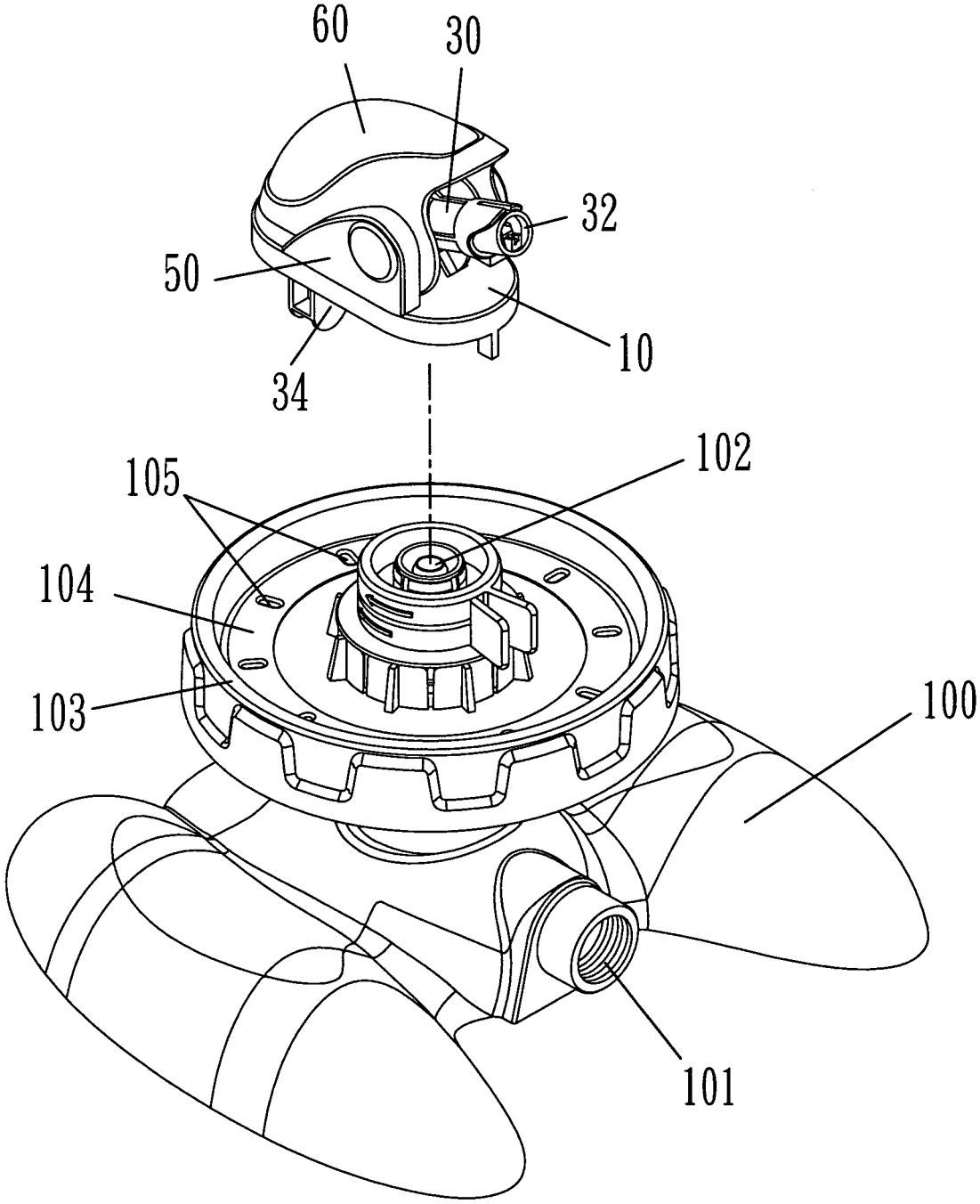
FIG. 8 is a schematic view showing a disassembly of a sprinkler and a sprinkler seat of the present invention.
Figure 9:
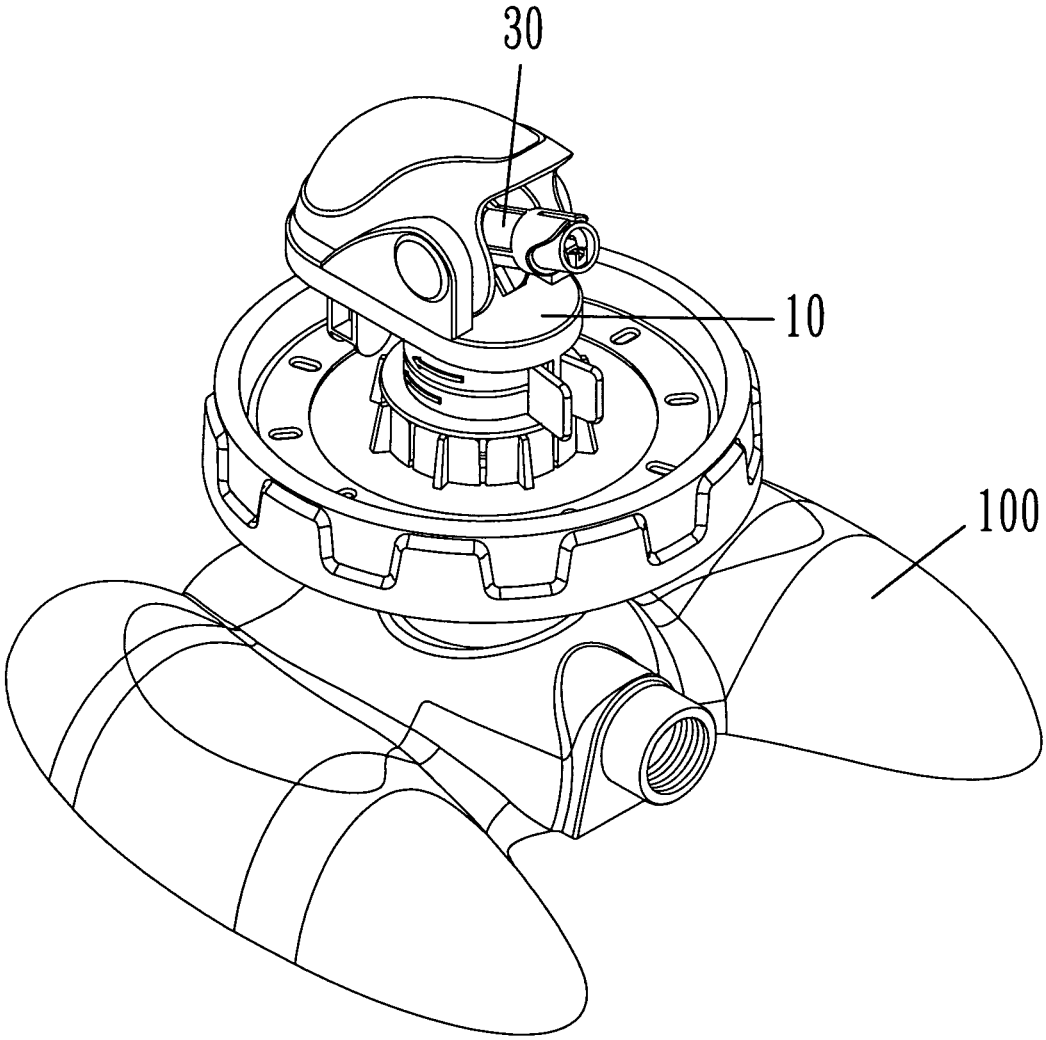
FIG. 9 is a schematic view showing a assembly of the sprinkler and the sprinkler seat of the present invention.

What is claimed is:

1. An adjustable sprinkler, comprising:

a base having a vertical water way, and a transverse through hole formed at an upper end of said vertical water way;

a transverse axle tube having an axial transverse water way formed therein, wherein said transverse water way has an open end connected to said transverse through hole of said base, wherein said transverse axle tube further has at least one water outlet formed to a peripheral of said transverse axle tube and is communicated with said transverse water way;

a mobile tube, having:

an axial water way formed therein;

a water outlet communicated with said axial water way;

a transverse axial hole formed on said mobile tube at a position adjacent to said water outlet and has an axial direction perpendicular to that of said axial water way, wherein said transverse axial hole is arranged to connect to said transverse axle tube, and has a plurality of protrusions formed on an inner wall of said transverse axle hole for selectively blocking said water outlet of said transverse axle tube; and an extension portion downwardly extended from said axial water way such that a center of gravity of said mobile tube is close to said extension portion while said transverse axle hole is regarded as a pivot; and an nozzle mounted to said water outlet of said mobile tube, in such a manner that when said protrusions of said transverse axle hole are moved away from said water outlets of said transverse axle tube so that said water outlets are not blocked by said protrusions, said water way of said mobile tube forms an angle of elevation such that water coming from said vertical water way of said base is arranged to first flow into said transverse water way of said transverse axle tube, and then into said transverse axle hole of said mobile tube through said water outlets of said transverse water way, and finally be sprinkled out of said water outlet through said water way of said mobile tube, wherein when said mobile tube is pivoted on said transverse axle tube, said angle of elevation of said mobile tube is arranged to decrease so that said protrusions are moved to block said water outlets so as to selectively adjust a flow rate of said water.

2. The adjustable sprinkler, as recited in claim 1, further comprising two water seals arranged between said transverse axle tube and said transverse axle hole, wherein said two water seals are arranged at two relative outer sides of said water outlet of said transverse axle tube.

3. The adjustable sprinkler, as recited in claim 2, further comprising an inner ring and an outer ring, wherein said water seals are located between an inner ring and an outer ring, and said inner ring and said outer ring are arranged to said transverse axle hole of said mobile tube.

4. The adjustable sprinkler, as recited in claim 3, further comprising a support frame, wherein an outer end of said transverse axle tube is a close end, wherein said support frame is mounted to said close end in such a manner that a bottom of said support frame is attached to an upper surface of said base.

5. The adjustable sprinkler, as recited in claim 4, wherein said support frame has a pivoting hole formed near at an upper end, wherein a bottom of said support frame is attached to said base, wherein said support frame has a rim for being buckled to said base.

6. The adjustable sprinkler, as recited in claim 5, further comprising a cover provided on said base and is arranged to cover said mobile tube and said extension portion of said mobile tube, in such a manner that only said nozzle is extended to an exterior of said cover.

7. The adjustable sprinkler, as recited in claim 6, wherein said cover has two symmetric front tenons and two symmetric rear tenons formed to two bottom lateral edges of said cover, whereas said base further has two symmetric front retaining recesses and two symmetric rear retaining recesses formed thereon for retaining said front and said rear tenons of said cover respectively.

* * * * *